US008360814B2

(12) United States Patent
Van Dan Elzen

(10) Patent No.: US 8,360,814 B2
(45) Date of Patent: Jan. 29, 2013

(54) YO-YO HAVING A MODIFIABLE STRING GAP

(76) Inventor: Hans W. Van Dan Elzen, Gilbert, AZ (US)

( * ) Notice: Subject to any disclaimer, the term of this patent is extended or adjusted under 35 U.S.C. 154(b) by 172 days.

(21) Appl. No.: 12/761,688

(22) Filed: Apr. 16, 2010

(65) Prior Publication Data

US 2011/0256793 A1 Oct. 20, 2011

(51) Int. Cl.
*A63H 1/30* (2006.01)
*A63H 1/06* (2006.01)

(52) U.S. Cl. ..... 446/250; 446/247

(58) Field of Classification Search ..... 446/247–254
See application file for complete search history.

(56) References Cited

U.S. PATENT DOCUMENTS 3,444,744 A 5/1969 Lindbergh
5,100,361 A 3/1992 Kuhn et al.
5,254,027 A * 10/1993 McAvoy, Jr. ..... 446/250
5,389,029 A * 2/1995 McAvoy, Jr. ..... 446/250
5,984,759 A * 11/1999 O'Sullivan ..... 446/250
6,077,145 A 6/2000 Ma
6,089,945 A 7/2000 Van Dan Elzen
6,162,109 A * 12/2000 Baier ..... 446/250
6,220,920 B1 * 4/2001 Baier ..... 446/250
6,331,132 B1 * 12/2001 Watson ..... 446/250
6,579,142 B1 * 6/2003 Rehkemper et al. ..... 446/247
6,599,165 B1 7/2003 Van Dan Elzen
6,887,122 B1 5/2005 Van Dan Elzen et al.
7,192,330 B2 * 3/2007 Van Dan Elzen ..... 446/250
2007/0026762 A1 2/2007 McPhee

* cited by examiner

*Primary Examiner* — Gene Kim
*Assistant Examiner* — Alyssa Hylinski
(74) *Attorney, Agent, or Firm* — Franklin L. Gubernick

(57) ABSTRACT

The invention is a yo-yo that includes unique features that enable a user to adjust the yo-yo's string gap. In the preferred embodiment, at least one of the yo-yo's side assemblies includes a screw engaged to a nut that has two thru-bores located in a side-by-side relation. The screw is located to one side of the yo-yo's axis of rotation and can be rotated by a user to adjust the position of the associated side assembly on the yo-yo's axle structure. By appropriate positioning of the side assembly, a user can adjust the yo-yo's performance characteristics.

20 Claims, 6 Drawing Sheets

YO-YO HAVING A MODIFIABLE STRING GAP

FIELD OF THE INVENTION

The invention is in the field of user-manipulated toys. More particularly, the invention is a yo-yo that includes unique structure that enables a user to adjust the yo-yo's string gap in a secure manner. In the preferred embodiment, at least one of the yo-yo's side portions includes an adjustment apparatus that is at least partially located off-center from the yo-yo's axis of rotation and acts on a body member that can slide in a direction parallel to the yo-yo's axle.

BACKGROUND OF THE INVENTION

Most yo-yos are in the form of two disk-shaped side portions that are rigidly connected to each other by some type of axle structure. The axle structure will normally include an elongated axle member that extends between the yo-yo's two side portions. In many modern yo-yos, the axle structure will also include a center-located bearing or other rotatable member that is positioned on said elongated axle member and forms an anchor for one end of a string-type tether. The free end of the tether is usually tied to create a loop portion that can be placed about one of a user's fingers to thereby secure the yo-yo to the user's hand.

When the tether is wound about the axle structure and the yo-yo is released or thrown from the user's hand, the yo-yo will begin to rapidly spin as it moves away from the user's hand and the tether unwinds from the axle structure. Once the tether is fully unwound, the yo-yo may "sleep" at the end of the tether, whereby the yo-yo continues to spin without the tether rewinding on the axle structure. Once the yo-yo is sleeping, there are a number of tricks, such as "walk the dog," that a person can perform with the spinning yo-yo. A sleeping yo-yo is also often used to perform tricks where the spinning yo-yo is temporarily placed upon a portion of the tether intermediate of the tether's two ends.

At the completion of most yo-yo tricks, the user will make a quick tug/jerk on the tether. This will result in a brief tightening of the tether, which is then automatically followed by a temporary slackening of the tether. Once the tether goes slack, the tether's twist will cause one or more portions of the tether located proximate the axle structure to move, and thereby contact a spinning portion of the yo-yo. Once contact has occurred, the tether portion can become snagged on, or otherwise engaged to, a spinning portion of the yo-yo in a manner whereby rotation of the spinning portion of the yo-yo causes the tether to wind about the axle structure. Winding of the tether on the axle structure causes the yo-yo to return to the user's hand.

There are three crucial performance characteristics of a yo-yo that enable a user to perform yo-yo tricks. The yo-yo must be capable of sleeping for an extended period of time, it should return on command, and it should be smooth on the tether.

Concerning a yo-yo's sleep time, the longer the yo-yo can be made to sleep, the more time the user will have to complete any particular yo-yo trick that requires the use of a sleeping yo-yo. It is well known that by minimizing friction in the yo-yo's components, one can maximize the yo-yo's sleep time. Furthermore, it is known that whenever the tether even slightly rubs against a spinning portion of the yo-yo, the created friction will reduce the yo-yo's sleep time. Therefore, a yo-yo that has a large string gap will often sleep longer than a similar yo-yo having a smaller gap since the larger string gap reduces the chances of the tether contacting a spinning portion of the yo-yo. A yo-yo's string gap is herein defined as the area located between the yo-yo's two side portions. The string gap has a width dimension that is normally measured proximate the yo-yo's axle structure and extends from one of the yo-yo's side portions to the other of the yo-yo's side portions.

For a yo-yo to return on command, the structure and design of the yo-yo must be such that when the user causes the tether to briefly go slack, a portion of the tether can become snagged on and/or engage a spinning portion of the yo-yo and thereby cause the yo-yo to return to the user's hand. For this characteristic, one would want a small string gap, since a narrow gap requires a smaller sideways movement of the tether in order for said tether to contact a spinning portion of the yo-yo. However, a narrower gap facilitates inadvertent contact between the tether and a spinning portion of the yo-yo which could lead to the yo-yo returning to the user's hand without the user knowingly causing, or wanting, said return to occur. A yo-yo's responsiveness is hereby defined as the ease with which one can cause the yo-yo to return on command. A yo-yo that often inadvertently returns to the user's hand may be considered too responsive. A wide string gap is often a significant factor in a yo-yo that exhibits low responsiveness.

A yo-yo's responsiveness is usually enhanced through the use of particular engagement adaptations, such as raised ribs, on the tether-facing surface of the yo-yo's side portions. The tether-facing surface of a side portion is herein defined as the surface of the side portion that faces a portion of the yo-yo's tether when said tether extends outwardly from the yo-yo when said yo-yo is sleeping.

Concerning a yo-yo's ability to be smooth on the tether, this refers to a yo-yo's ability, when it is sleeping at the end of the tether, to be temporarily placed on a medial portion of the tether without the tether snagging on a spinning portion of the yo-yo. An example of a trick that requires a yo-yo to be smooth on the tether is "man on the trapeze." If, during such a trick, the yo-yo can slide on the tether, the yo-yo is said to be very smooth on the tether/string. The ability of a yo-yo to be smooth on the tether is favored when the yo-yo's responsiveness is low, a condition usually associated with a wide string gap.

Another important consideration involved in the design/performance of a yo-yo is the wear rate of the yo-yo's tether and the portion(s) of the yo-yo that engage said tether. Wear occurs whenever the tether contacts a spinning portion of the yo-yo. A large string gap favors reduced wear.

The size of a yo-yo's string gap can also affect the yo-yo's dynamic characteristics when it is used to perform certain tricks. For example, a yo-yo having a wide string gap, where there is considerable distance between major portions of the yo-yo's two side portions, will tend to be more stable and easier to catch on a string. A yo-yo having a narrow string gap, where there is only a small spacing between major portions of the yo-yo's two side portions, will tend to be easier to use for performing looping tricks in which the yo-yo flips over when it passes the user's wrist.

It is known in the prior art to provide a yo-yo with structure that enables a user to adjust the size of the yo-yo's string gap. In such a yo-yo, to facilitate the performance of some tricks, one adjusts the yo-yo so that it has a narrow string gap. For other tricks, or if one wants to optimize the life of the yo-yo, the yo-yo is adjusted so that it has a wide string gap.

In most of the yo-yos that feature adjustable string gap, adjustment is accomplished via the yo-yo's axle structure. Both side portions are normally threadedly engaged to an elongated axle member whereby a user can rotate one of the side portions relative to the other side portion to thereby cause a change in the string gap. To prevent the side portions from inadvertently rotating relative to each other, it is known to employ one or more resilient o-rings on the axle member and/or employ one or more axle nuts that have a deformable portion and/or employ a detent-type locking apparatus secured to the axle member. However, repeated relative movements of the yo-yo's side portions can wear out such structures. Furthermore, such structures have limited strength to prevent inadvertent relative rotation between the side portions that could lead to changes in the yo-yo's string gap.

In U.S. Pat. No. 5,100,361, a yo-yo is taught in which a user can adjust the string gap by adjusting the position of gap screws that are located within cylindrical plugs secured into the center of disk-shaped wooden bodies. Adjustment of the screws is accomplished by taking the yo-yo apart, whereupon the user can employ a specially-shaped tool, or a fingernail, to turn said screws.

FIGS. 1 and 2 of the instant application show a prior art yo-yo 1, produced by Tom Kuhn Yo-Yos Ltd., that is functionally similar to the yo-yo shown in U.S. Pat. No. 5,100,361. However, in the yo-yo shown, each of the yo-yo's side portions 2 features a metal body 4 that has a center-located bore 6 that features interior threads 8. Each side portion further includes a gap screw 10 that has exterior threads 12 that engage the threads 8 of the body. Adjustment of the yo-yo's string gap is accomplished in the same manner and with the same tool as taught in U.S. Pat. No. 5,100,361. A user is required to disassemble the yo-yo and then rotate the gap screws to thereby cause the bodies to be closer or further apart when the yo-yo is reassembled.

However, the method of changing the string gap in the above-described yo-yo may require multiple repetitions of the adjustment process before the yo-yo exhibits the desired performance characteristics. Since said process requires the disassembly of the yo-yo for each adjustment of the gap screws, said process can be time consuming.

In addition, and most importantly, the prior art yo-yos that enable the string gap to be adjusted employ an adjustment apparatus that relies on a rotation of a part of the yo-yo wherein said rotation is about the same axis as the yo-yo's axis of rotation. As a result, when the yo-yo is rotating in its normal manner and the yo-yo returns to the user's hand, rotative forces can be created within the yo-yo that can act on the string gap adjustment apparatus and cause a change in the yo-yo's string gap. For example, when the yo-yo is returning to the user's hand, if the yo-yo hits the hand in a manner whereby both side portions of the yo-yo do not stop at the exact same time, there can be relative rotation of the side portions that will change the yo-yo's string gap.

Therefore, a yo-yo is needed in which the yo-yo's string gap can be easily, quickly, securely and precisely changed to meet the needs of the user. Furthermore, there is a need for a yo-yo in which the string gap can be adjusted and in which forces internally generated within the yo-yo will not inadvertently act to change the yo-yo's string gap.

SUMMARY OF THE INVENTION

The invention is an improved yo-yo that includes unique structure that enables a user to adjust the yo-yo's string gap in a secure manner. By adjusting the string gap, the user can change the yo-yo's performance characteristics including potential sleep time, ability to return on command, and ability to be smooth on the string. In the preferred embodiment, at least one of the yo-yo's two side portions includes a body member that can slide relative to the yo-yo's elongated axle member. Adjustable positioning of the body member is accomplished using an off-center adjustment apparatus that preferably features a unique multi-thru-bore nut that has two thru-bores located in a side-by-side relation.

The use of a user-positionable body member enables a user to adjust the yo-yo so that its performance characteristics can be tailored to facilitate the performance of any particular yo-yo trick. A user wishing to perform a variety of yo-yo tricks is no longer required to own, transport or maintain multiple yo-yos. A yo-yo in accordance with the invention can be precisely and quickly adjusted to enable its use by players of any skill level and for the performance of an almost unlimited range of yo-yo tricks. Locating the rotatable element of the adjustment mechanism off-center from the yo-yo's axis of rotation substantially eliminates the possibility of internally-generated rotative forces in the yo-yo from changing the yo-yo's string gap. The adjustment apparatus involves a screw that can apply force, either directly or indirectly, on the body member and which is readily accessible even when the yo-yo is in a fully assembled condition.

DETAILED DESCRIPTION OF THE DRAWINGS

Figure 2:
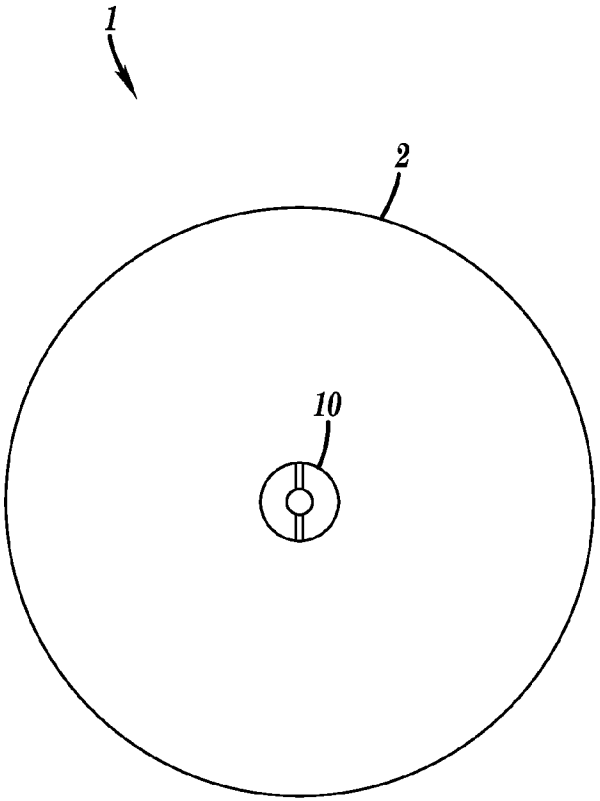
FIG. 2 PRIOR ART
FIG. 2 is a side view of a portion of the yo-yo shown in FIG. 1 and taken at the plane labeled 2-2 in FIG. 1.
Figure 1:
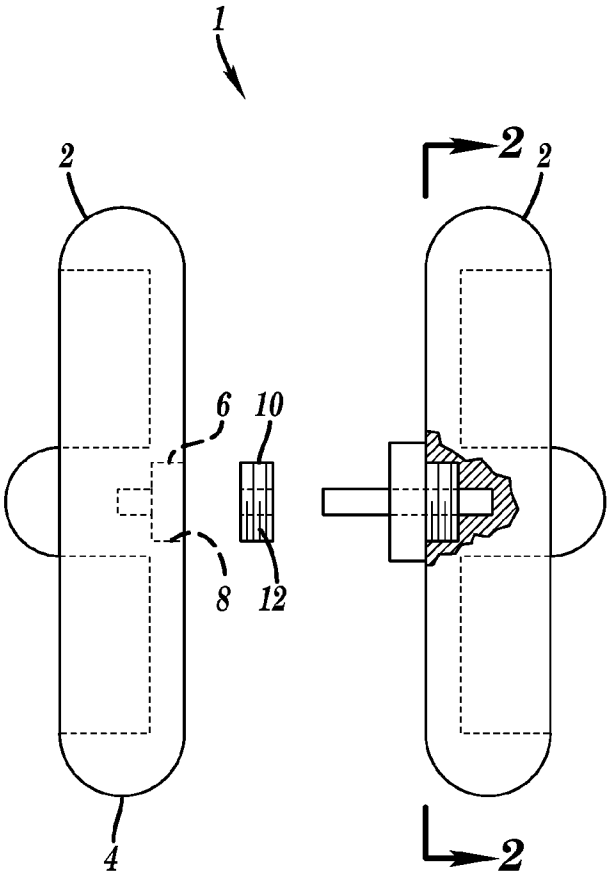
FIG. 1 PRIOR ART
FIG. 1 is a front view of a prior art yo-yo, shown in exploded and partial cut-away fashion.

Looking now to the drawings in greater detail, wherein like reference numerals refer to like parts throughout the several figures, there is indicated by the numeral 30 a yo-yo in accordance with the invention.

The yo-yo 30 includes first and second side portions, 32 and 34 respectively, connected together via an axle structure 36. A string-type tether 38 includes a loop portion 40 that encircles a center portion of the axle structure. The tether's distal end (not shown) will normally be tied to create a loop that enables a temporary securement of said end to one of a user's fingers.

The axle structure 36 is preferably an assemblage of parts and includes an elongated axle member 42, a ball bearing unit 44, a pair of cup-shaped washers 46 and a nut 48. The elongated axle member has a longitudinal axis that is preferably collinear with the yo-yo's axis of rotation 49 that extends through the center of both of the yo-yo's side portions. Member 42 is preferably in the form of a straight metal rod that has first and second ends, 50 and 52 respectively. End 50 preferably features exterior threads 54 that extend to a shoulder 56. End 52 preferably includes an outwardly-extending hexagonally-shaped portion 58.

The ball bearing unit 44 is preferably conventional in design and comprises an inner race 60 that defines a center opening 62, an outer race 64 and a plurality of balls 65 located between the races. Opening 62 is sized to inwardly receive the axle member 42. It should be noted that other types of rotatable units or members can be used in lieu of the ball bearing unit shown. Alternatively, the ball bearing unit can be dispensed with when the yo-yo's tether is attached directly to the axle member, or to a structure fixedly secured to said axle member, or to an equivalent structure that connects together the yo-yo's two side portions.

The washers 46 are preferably made of a hard material, such as metal, and each has a center aperture 66. Located adjacent the aperture is a surface 67 that faces the side of the ball bearing unit. It should be noted that the washer can be thicker near aperture 66 whereby surface 67 can only contact the ball bearing unit's inner race 60.

Side portion 32 includes a disk-shaped body member 68 and a cap 70. Said body member has a thru-bore 72, an inwardly-facing surface 74 and a peripherally-located rim portion 76 that surrounds an outwardly-facing cavity 78.

Located at the center of surface 74 is a circular cavity 80. The cavity has a circular sidewall 82 and a rear surface 84. The body member's thru-bore extends through the center of cavity 80. Said cavity is designed to inwardly receive at least a portion of one of the washers 46.

Located on surface 74 radially-outwardly of cavity 80 are a plurality of raised ribs 86 arrayed in a starburst pattern. The ribs function to enhance the ability of surface 74 to snag/engage a portion of the tether when a user makes an appropriate hand movement to cause the yo-yo to return. Alternatively, surface 74 may be featureless or it may have other forms of adaptations to facilitate tether engagement. For example, instead of raised ribs, surface 74 may have an array of indentations, spaced pads/protrusions, movable ribs or include a ring of a material, such as rubber, that has a relatively high coefficient of friction.

The body member's outwardly-facing cavity 78 has a circular sidewall 90 that includes an inner portion 92 and an outer portion 94. Located at the center of cavity 78 is an outwardly-extending nipple portion 96 of the body member. The body member's thru-bore extends through said nipple portion and into a hex-shaped, outwardly-facing cavity 98 in said nipple portion.

Secured to the body member in a position to cover cavity 78 is the disk-shaped cap 70. The cap has a peripherally-located inwardly-extending lip 100 that is preferably received within cavity 70 and fits against the outer portion 94 of sidewall 90. There can be a slight interference fit between said lip and said sidewall to enable a releasable securement between the cap and body member.

Side portion 34 includes a body member 102, an allen screw 106 and a cap 108. When in an assembled condition, the nut 48 is secured within side portion 34.

The body member 102 has a thru-bore 110, an inwardly-facing surface 112 and a peripherally-located rim portion 114. The rim portion surrounds an outwardly-facing cavity 116.

Located at the center of surface 112 is a circular cavity 80. The cavity has a circular sidewall 84 and a rear surface 86. The body member's thru-bore extends through the center of cavity 80 whereby the cavity is designed to inwardly receive at least a portion of one of the washers 46.

Located on surface 112 radially-outwardly of cavity 80 are a plurality of raised ribs 86 arrayed in a starburst pattern. Said raised ribs are preferably functionally and structurally identical to those of body member 68. Said ribs may not be included or they may be replaced by other structures, as previously described for body member 68.

Located at the center of the outwardly-facing cavity 116 is an outwardly-extending nipple portion 124 of the body member. The body member's thru-bore extends through said nipple portion and into one end of a figure-eight-shaped cavity 126. The cavity has a rear/bottom surface 128 and a sidewall 129.

Cavity 116 has a circular sidewall 130 that includes an inner portion 132 and an outer portion 134. Sidewall portion 134 preferably includes two spaced-apart grooves 138.

Fitted within the nipple portion's cavity 126 is the nut 48. Said nut is preferably of a unique multi-thru-bore design whereby said nut includes first and second thru-bores, 140 and 142 respectively. Said thru-bores are located adjacent to each other whereby said nut has a shape similar to a figure eight. Thru-bore 140 is tapped to include interior threads 144, while thru-bore 142 is tapped to include interior threads 146. While nut 48 is preferably made of a hard metal material, such as steel, said nut may instead be made of other hard materials, including hard plastics. It should be noted that the nut is designed to be placed into cavity 126 in the nipple portion with thru-bore 142 aligned with the body member's thru-bore 110. The sidewall 129 of cavity 126 is preferably shaped to closely fit adjacent the nut's side surface 148 to thereby prevent any movement of said nut within said cavity.

The allen screw 106, also known as a socket head cap screw, socket screw and an allen bolt, is designed to threadedly engage thru-bore 140 of nut 48. This is accomplished by the body 149 of the allen screw 106 having exterior threads 150 that can engage the interior threads 144 of thru-bore 140. The allen screw includes a head portion 152 that features a hex-shaped socket 154 and an outwardly-extending flange portion 156. It should be noted that as an alternative to the allen screw 106 having an integral flange portion 156, a different screw can be employed in its place that achieves the function of the flange portion differently, such as via an outwardly-extending circlip that is fixedly-secured to the body of said screw or via a washer that fits over the head portion of a similar screw and abuts a widened body portion of said screw.

The disk-shaped cap 108 is secured to the body member in a position whereby said cap covers cavity 116. The cap has a peripherally-located inwardly-extending lip 158 that is permanently, or releasably, received into the cavity 116 adjacent the cavity's sidewall portion 134. The two grooves 138 in sidewall portion 134 are adapted to receive two tabs 160 that depend from said lip 158. The cap is designed to be located atop the allen screw wherein fitting the tabs 160 into said grooves facilitates aligning an aperture 162 in the cap with the socket 154 of the allen screw. One should also note that the inwardly-facing surface 164 of the cap includes an inwardly-extending portion 166 designed to fit atop the nut 48. Said portion 166 includes a cavity 170 sized to inwardly receive the allen screw's head portion. One should note that cavity 170 includes a rear surface 172 designed to abut the allen screw's flange portion 156.

When a yo-yo 30 is assembled, one preferably first assembles side portion 34 by placing the nut 48 into cavity 126 of the body member's nipple portion 124. With the nut in place, the allen screw 106 is then fully threaded into the nut's thru-bore 140, said thru-bore being offset from the body member's thru-bore 110. Next, cap 108 is secured to the body member 102 with the cap's lip 158 fitting against the outer sidewall 134 of the body member. The allen screw's socket 154 should be visible through the cap's aperture 162 when the cap's tabs 160 are inserted into the body member's grooves 138. Preferably, once properly positioned, the cap is then locked to the body member via sonic welding, an adhesive, or through the use of fasteners (not shown).

One can then insert the elongated axle member 42 through the thru-bore 72 of body member 68 until the axle member's hexagonally-shaped portion 58 is received within the complementary hex-shaped cavity 98 in the body member's nipple portion 96. Cap 70 is then secured to the body member 68. Next, the ball bearing unit 44 and washers 46 are placed onto the axle member whereby the washers sandwich the ball bearing unit in the manner shown in FIGS. 5 and 8. It should be noted that the cup shape of the washers is sized and shaped whereby the bearing's outer race does not contact the washers and may spin freely relative to, and independently of, the yo-yo's side portions.

Figure 5:
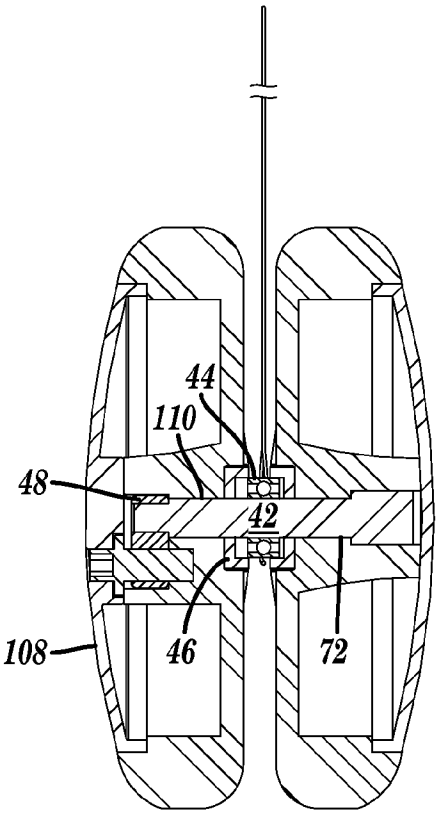
FIG. 5 is a cross-sectional view of the yo-yo shown in FIG. 3, taken at the plane labeled 5-5 in FIG. 4.
Figure 4:
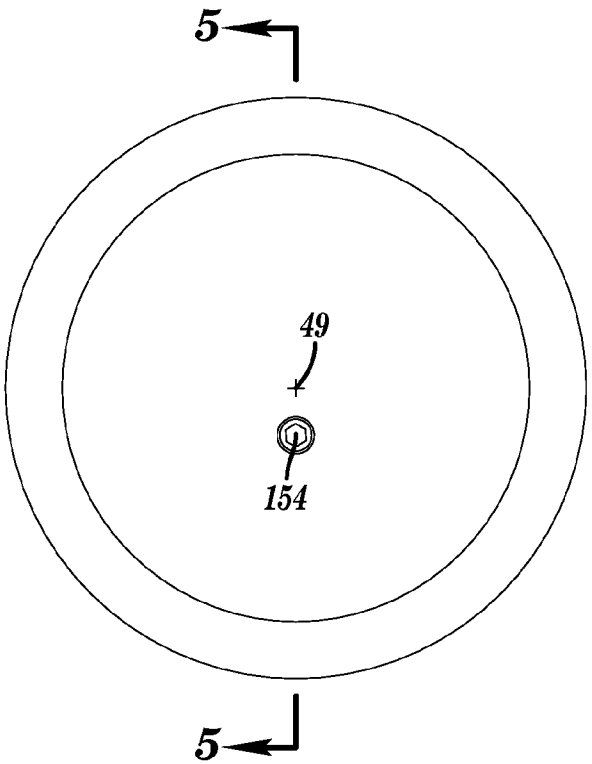
FIG. 4 is a side view of the yo-yo shown in FIG. 3 and taken at the plane labeled 4-4 in FIG. 3.
Figure 3:
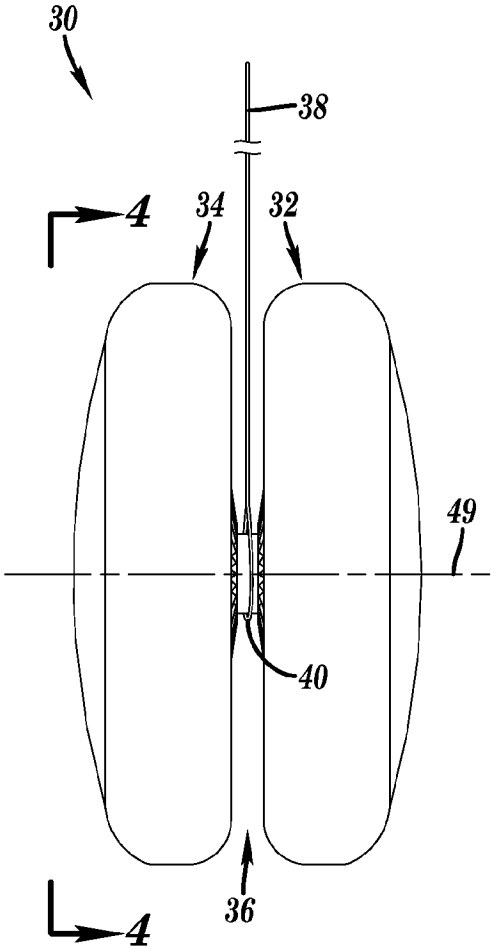
FIG. 3 is a front view of a yo-yo in accordance with the invention.
Figure 6:
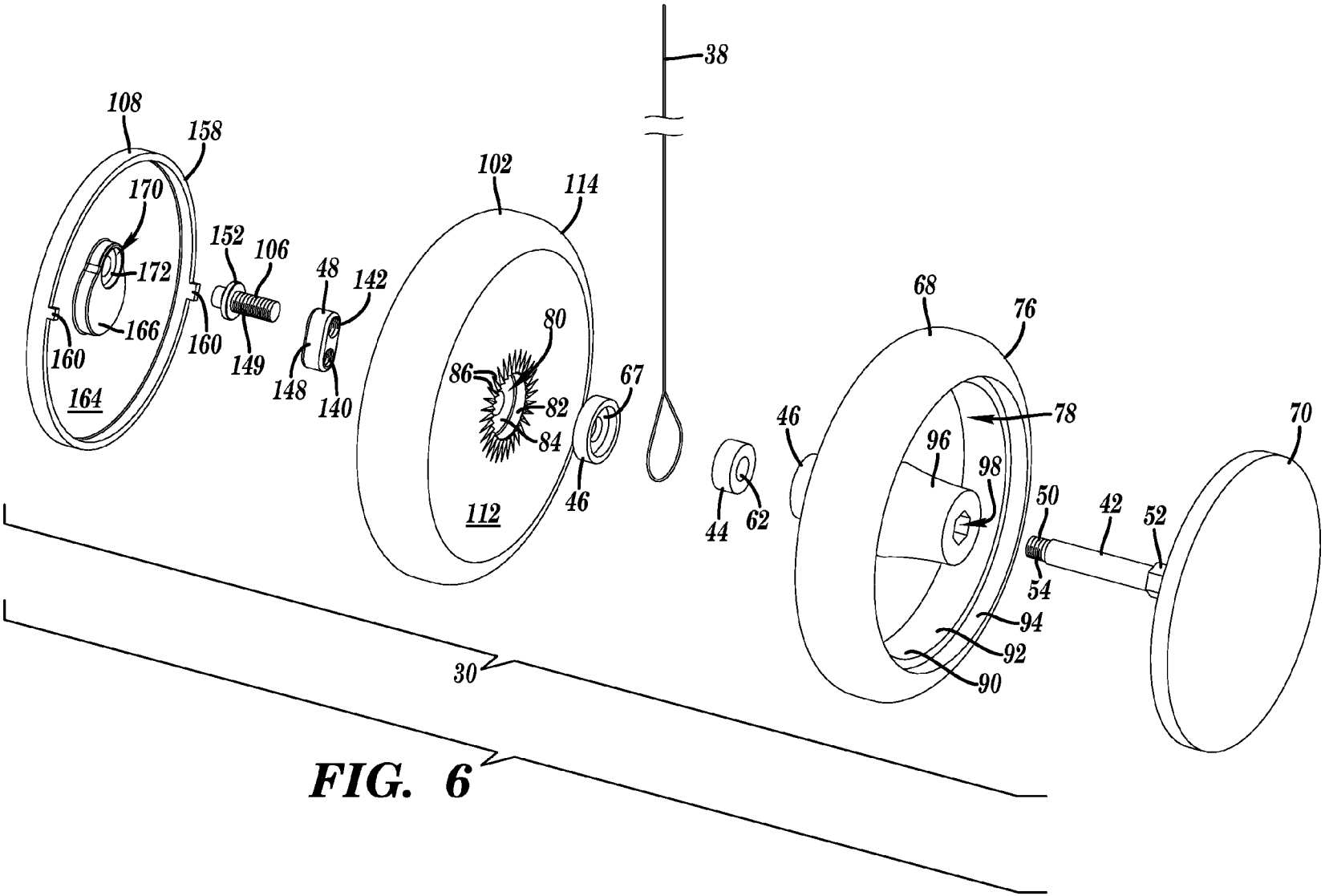
FIG. 6 is a perspective, exploded side view of the yo-yo shown in FIG. 3.
Figure 8:
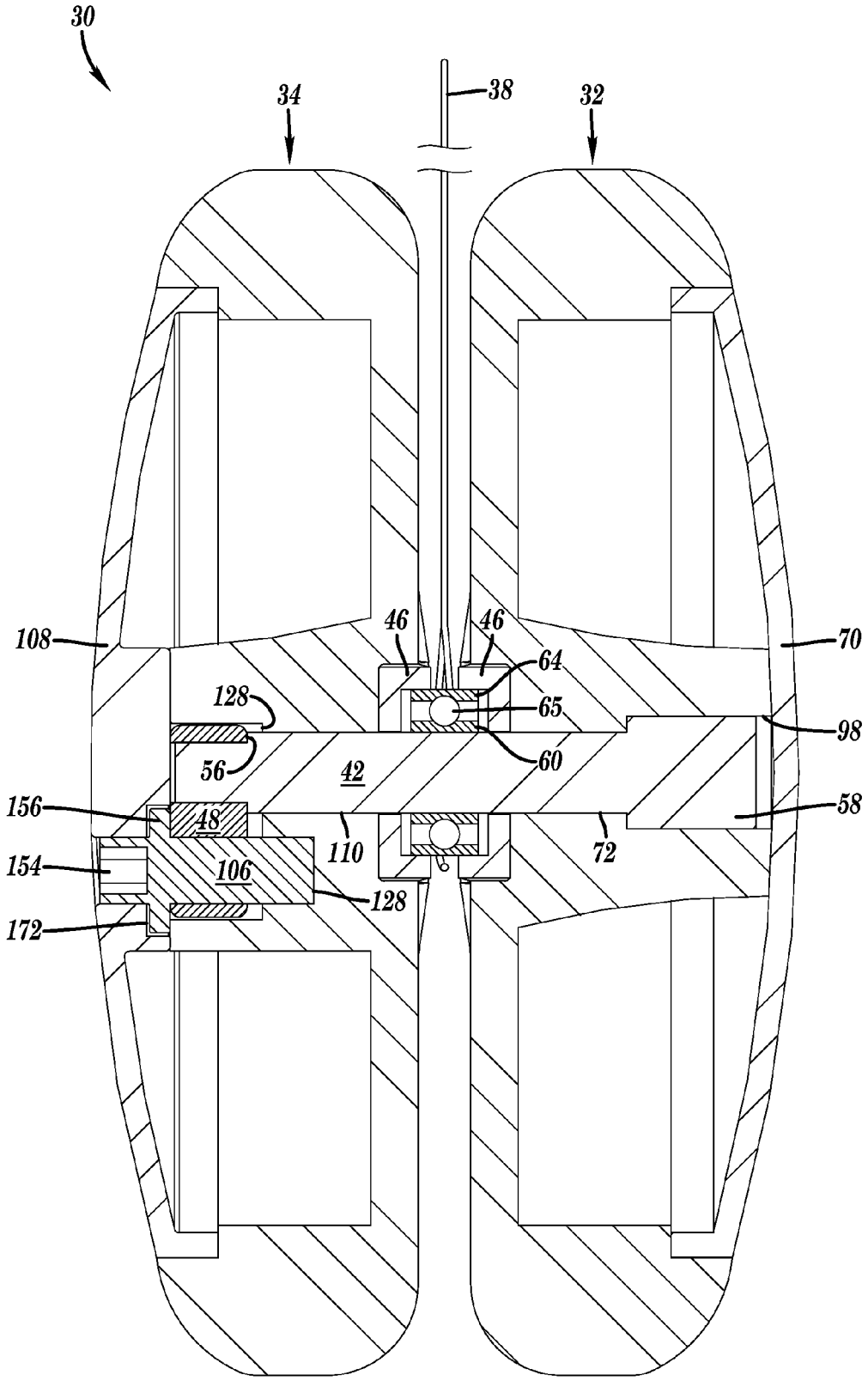
FIG. 8 is a cross-sectional view similar to FIG. 5 showing the yo-yo of FIG. 3 but showing said yo-yo with a minimum string gap.

Next, end 50 of the axle member is inserted into the thru-bore 110 of body member 102 until the threads 54 of the axle member engage the interior threads 146 of the thru-bore 142 of nut 48, as shown in FIGS. 5 and 8. A user can then rotate one of the yo-yo's side portions relative to the other of the yo-yo's side portions to cause the axle member to move into the nut 48 via the engagement between the threads 54 and threads 146. One continues to rotate the side portion until the nut 48 contacts the axle member's shoulder 56 (note FIGS. 5 and 8). When the yo-yo is to be used in a conventional manner, the tether's loop portion 40 is placed about the ball bearing unit 44.

Figure 7:
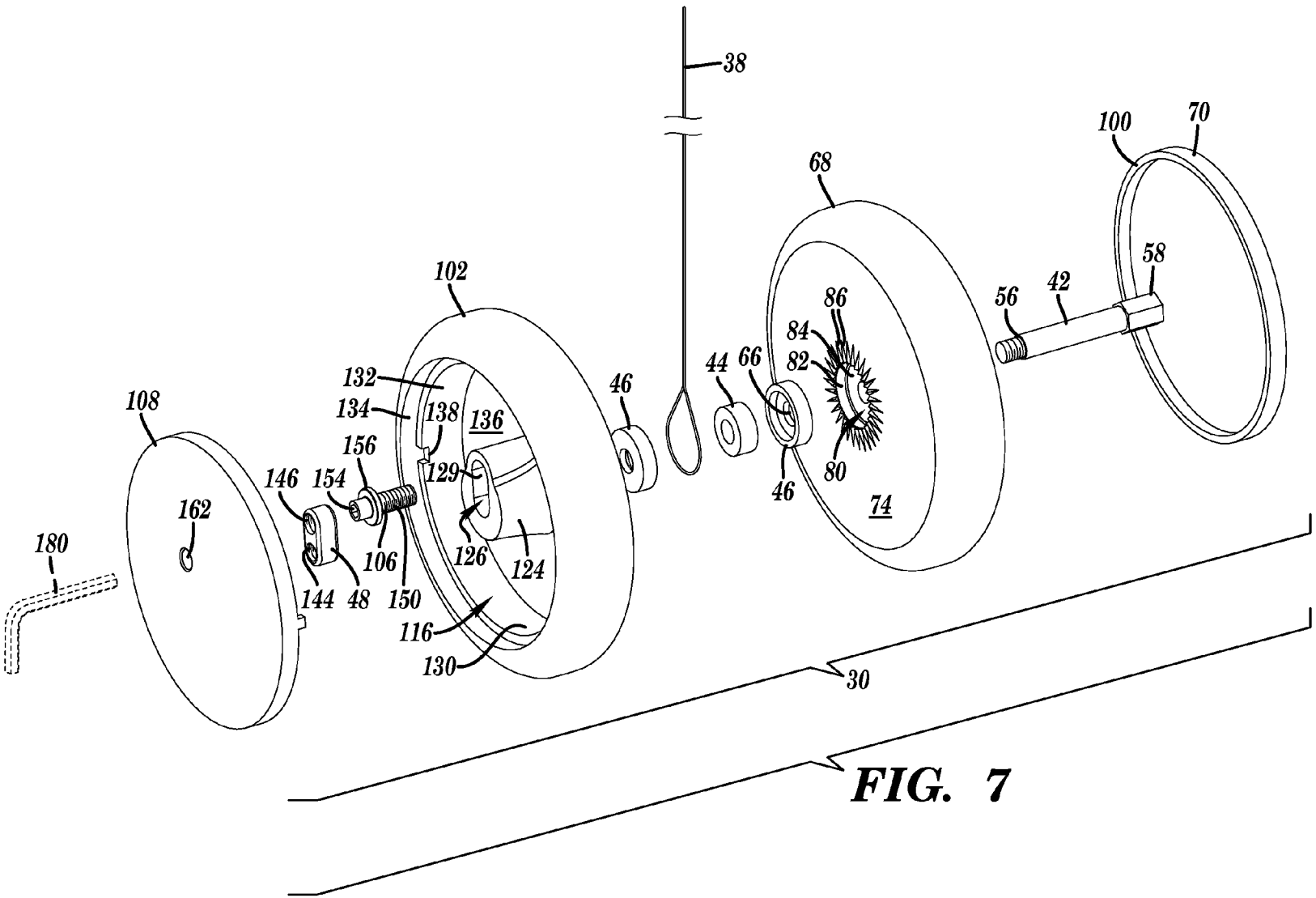
FIG. 7 is a perspective, exploded side view of the yo-yo shown in FIG. 3 but with the yo-yo rotated approximately sixty degrees from the view shown in FIG. 6. Also in this figure, a tool usable with the yo-yo is shown in phantom.

Once the yo-yo 30 is in an assembled condition, a user can adjust the yo-yo's responsiveness and string gap by adjusting the position of side portion 34 on the axle member 42. An allen wrench 180 (shown in phantom in FIG. 7), also known as a hex key or allen key, is used to turn the allen screw 106. Alternatively, any tool having a properly sized and shaped tip can be used in place of tool 180.

One should note in FIGS. 5 and 8 that the allen screw 106 is captured between the rear/bottom surface 128 of cavity 126 in the body member's nipple portion and rear surface 172 of cavity 170 in the cap 108. Depending on the direction in which the allen screw is rotated, either the head of the allen screw will apply outward pressure on cap 108, or the threaded end of the allen screw will apply inward pressure on body member 102.

When the yo-yo is as shown in FIG. 8 and the allen screw is rotated so that it moves to the left, the allen screw moves outwardly from the nut as the screw's flange portion 156 applies outward force on surface 172 of the cap. This causes the cap, with the attached body member 102, to slide laterally outwardly in a direction away from the yo-yo's other side portion 32. It should be noted that sliding is herein defined as a movement that does not require rotation of the member being moved. By enabling the body member to slide laterally without having the body member rotate relative to the yo-yo's other side portion, as required by other yo-yos that have adjustable string gap, the invention avoids having any relative rotation of the yo-yo's side portions affecting the string gap adjustment apparatus.

One should note in FIG. 8 that there is a space to the right of nut 48 between said nut and the facing surface of the body member. Once body member 102, as well as side portion 34, has moved to the position shown in FIG. 5, that space will have disappeared while a new space will have been created to the left of nut 48. Said new space is located between said nut and the facing surface of cap 108 and also between said nut and the flange portion 156 of the allen screw. Therefore, turning of the allen screw has caused the body member to slide in a direction parallel to the longitudinal axis of the axle member 42 from a position where the string gap is at a minimum to a position where the string gap is at a maximum. Similarly, rotating the allen screw in the opposite direction from the position shown in FIG. 5 would cause a sliding of the body member in the opposite direction to thereby change the string gap from a maximum to a minimum. While the two extreme positions of the string gap adjustment are shown, a user can turn the allen screw a smaller amount to thereby cause changes of the string gap between said minimum and maximum amounts.

One should note that the yo-yo may optionally include an o-ring, marcel spring or other resilient member on the axle member 42 adjacent and outwardly of a washer 46 to maintain pressure on the axle structure when the string gap is widened. Furthermore, while an allen wrench is preferred, the allen screw may be replaced by a different type of fastener, such as a Phillips head bolt/screw or slotted-head bolt/screw to enable adjustment using a Phillips head or slotted screwdriver, respectively. It is also possible to replace the allen screw 106 with another screw or mechanism that does not require the use of a tool for making adjustments to the yo-yo's string gap. An example of a tool-less string gap adjustment mechanism is shown in FIG. 9.

Figure 9:
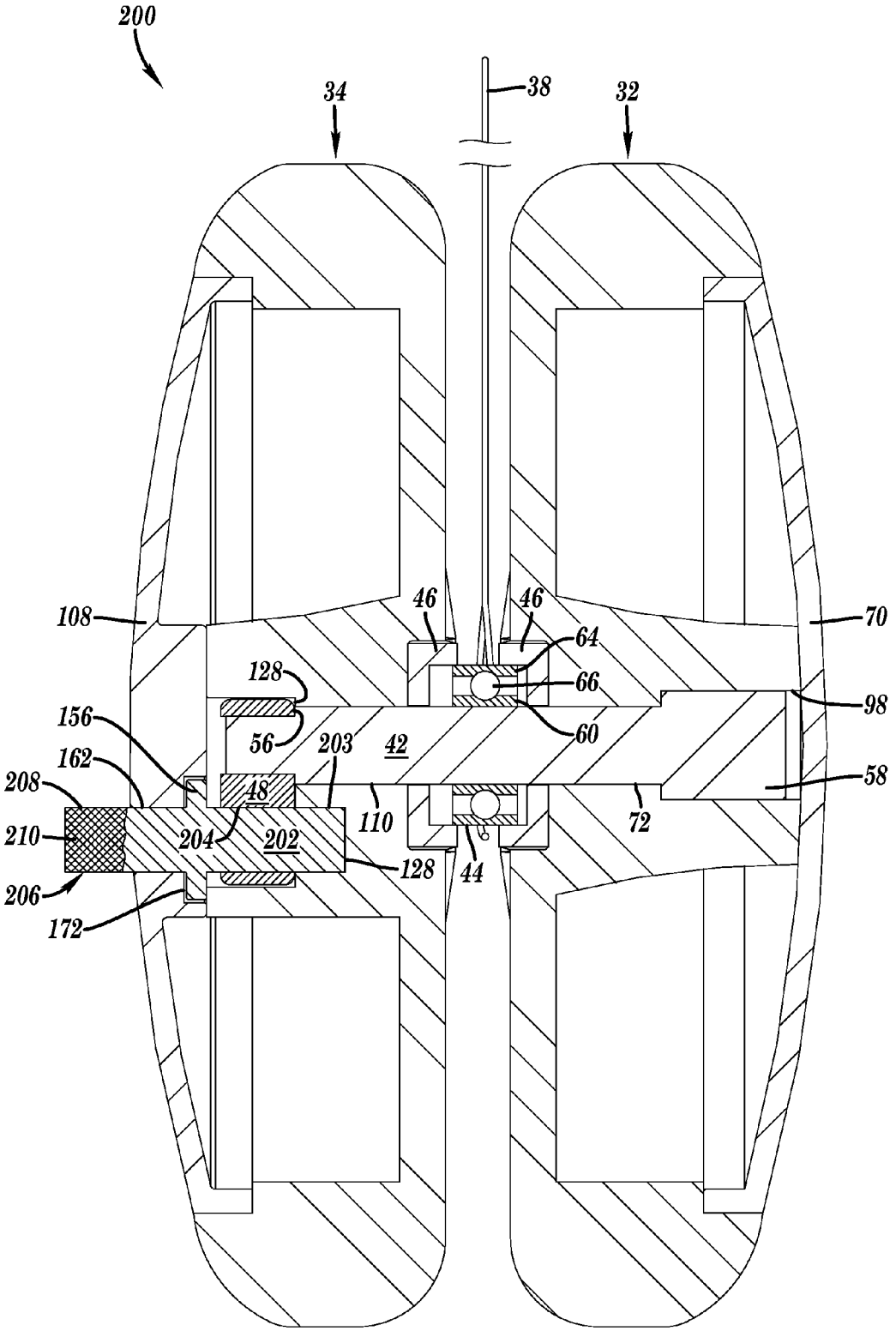
FIG. 9 is substantially a cross-sectional view that is similar to FIG. 5 and shows a second embodiment of a yo-yo in accordance with the invention. It should be noted that the tip of the yo-yo's alien screw is not shown in cross-section.

FIG. 9 shows an alternate embodiment of a yo-yo 200 in accordance with the invention. Yo-yo 200 is identical to yo-yo 30 except that it employs a user-graspable screw 202 in place of the allen screw 106 employed in yo-yo 30.

Screw 202 features a body portion 203 having exterior threads 204, and a head portion 206. The head portion features an outwardly-extending flange portion 156 and a cap portion 208. Said cap portion extends through aperture 162 in the cap 108 and features a knurled side surface 210. A user wishing to change the yo-yo's string gap can merely grasp and then rotate cap portion 208 to thereby cause screw 202 to move in the same manner as allen screw 106 moved in the nut 48 of yo-yo 30.

It should be noted that the string gap adjustment apparatus described herein can be used in yo-yos that have a different shape or structure than the yo-yos shown.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A yo-yo comprising:

first and second side portions secured together in a spaced-apart relation by an axle structure, wherein an axis of rotation extends through a center portion of both side portions, and wherein said axle structure comprises an axle member that extends between said side portions;

a tether secured to a portion of said axle structure;

wherein said first side portion includes a body member that forms a majority portion of said first side portion, wherein said first side portion has a rim portion located at the periphery of said body member in a manner whereby said rim portion will normally contact a user's hand when the yo-yo returns to said user's hand upon completion of a yo-yo trick, and wherein said body member is slidably secured to said axle structure;

wherein said yo-yo has a string gap that has a width dimension that extends between said body member and said second side portion, and wherein during normal use of said yo-yo, said tether will extend outwardly through said string gap; and an adjustment apparatus operatively connected to said axle structure and to said body member, wherein said adjustment apparatus is capable of causing a change in said width dimension of said string gap and includes a portion that is rotatable by a user to thereby cause said body member to slide in a direction that changes said width dimension of said string gap and simultaneously changes a distance between said rim portion and said second side portion, and wherein said portion of said adjustment apparatus is rotatable about an axis that is offset from said axis of rotation.

2. A yo-yo comprising:

first and second side portions secured together by an axle structure, wherein an axis of rotation extends through a center portion of both side portions, and wherein said axle structure comprises an axle member that extends between said side portions;

wherein said first side portion includes a body member, wherein said body member is slidably secured to said axle structure in a manner whereby said body member can slide laterally without rotating and thereby be capable of movement in a direction parallel to said axis of rotation, wherein said first side portion has a rim portion located at a periphery of said body member, wherein said rim portion will usually contact a user's hand when the yo-yo returns to said user's hand upon completion of a yo-yo trick, and wherein a string gap is located between said body member and said second side portion;

a tether secured to a portion of said axle structure whereby said tether will extend outwardly from said string gap when the yo-yo is sleeping;

an adjustment apparatus operable by a user to change a width dimension of said string gap, wherein said adjustment apparatus comprises first and second portions, wherein said first portion of said adjustment apparatus is secured to said axle member, wherein said second portion of said adjustment apparatus is operatively connected to said first portion of said adjustment apparatus and to said body member, and wherein said second portion of said adjustment apparatus can be moved by a user to cause said body member to slide in a direction that causes a change in said width dimension of said string gap; and wherein when said second portion of said adjustment apparatus is moved in a first manner, pressure is applied to a portion of said first side portion by said adjustment apparatus to thereby cause said body member and said rim portion to move in a direction toward said second side portion, and wherein when said second portion of said adjustment apparatus is moved in a second manner that is different from said first manner, pressure is applied to a portion of said first side portion by said adjustment apparatus to thereby cause said body member and said rim portion to move in a direction away from said second side portion.

3. The yo-yo of claim 2 wherein said first portion of said adjustment apparatus comprises a member having a thru-bore through which said axle member extends.

4. The yo-yo of claim 3 wherein said thru-bore includes interior threads that threadedly engage exterior threads located on said axle member.

5. The yo-yo of claim 2 wherein said second portion of said adjustment apparatus comprises an elongated member rotatably secured to said first portion of said adjustment apparatus.

6. The yo-yo of claim 2 wherein said second portion of said adjustment apparatus extends into a bore located in said first portion of said adjustment apparatus.

7. The yo-yo of claim 6 wherein said bore in said first portion of said adjustment apparatus is a thru-bore that features interior threads and wherein said second portion of said adjustment apparatus comprises an elongated member having exterior threads that threadedly engage said interior threads of said thru-bore.

8. The yo-yo of claim 2 wherein said second portion of said adjustment apparatus comprises a member that has a shaped end portion to which a user can attach a tool to facilitate moving said second portion of said adjustment apparatus.

9. The yo-yo of claim 8 wherein said member of said second portion of said adjustment apparatus is an allen screw and wherein said shaped end portion comprises a hexagonally-shaped socket.

10. The yo-yo of claim 2 wherein said second portion of said adjustment apparatus comprises a member having a shaped end portion that extends outwardly from said yo-yo in a position whereby said shaped end portion can be grasped by a user's hand and moved in a manner that causes a change in said width dimension of said string gap.

11. The yo-yo of claim 2 wherein said first and second portions of said adjustment apparatus are predominantly covered by a cap, and wherein said cap includes an aperture that provides exterior access to said second portion of said adjustment apparatus.

12. The yo-yo of claim 2 wherein said first portion of said adjustment apparatus is in the form of a member that includes first and second substantially parallel thru-bores, wherein each of said thru-bores has interior threads, and wherein said axle member includes exterior threads engaged to one of said thru-bores and wherein said second portion of said adjustment apparatus comprises a member having exterior threads engaged to the other of said thru-bores.

13. The yo-yo of claim 2 wherein said first portion of said adjustment apparatus is located relative to said body member in a manner whereby when said adjustment apparatus causes said body member to slide, a portion of said body member will slide past at least a portion of said first portion of said adjustment apparatus.

14. The yo-yo of claim 2 wherein said first portion of said adjustment apparatus is fixedly secured to said body member.

15. The yo-yo of claim 2 wherein said first side portion also comprises a cap that is affixed to and covers a portion of said body member, wherein said cap has an outwardly-facing surface and an inwardly-facing surface, wherein a portion of said inwardly-facing surface faces said first portion of said adjustment apparatus and can contact said second portion of said adjustment apparatus.

16. The yo-yo of claim 15 wherein said cap is secured to said body member in a manner whereby when said adjustment apparatus is used to change the string gap from a minimum width to a maximum width, said second portion of said adjustment apparatus is moved whereby it presses on said inwardly-facing surface of said cap and thereby causes said body member to move away from the yo-yo's second side portion.

17. The yo-yo of claim 2 wherein said second portion of said adjustment apparatus comprises a member that is rotatable about an axis that is offset from said axis of rotation.

18. A toy for use with a tether, said toy comprising:

first and second side portions secured together in a spaced-apart relation by an axle structure, wherein said axle structure includes a nut member fixedly secured to said first side portion, wherein a string gap is located between said side portions, and wherein during normal use of said toy, a tether will extend through said string gap;

wherein said first side portion is movable in a manner that changes said string gap and includes a peripherally-located rim portion that will normally contact a user's hand when the toy is being held by said user;

an adjustment apparatus having a screw member operatively connected to a portion of said first side portion, wherein said screw member is engaged to said nut member in a manner whereby rotation of said screw member can cause pressure to be applied to said portion of said first side portion in a manner whereby said first side portion moves and thereby changes a width dimension of said string gap, and wherein said screw member can be rotated when said toy is in a substantially assembled condition; and wherein when said screw member is rotated in a first direction, pressure is applied to a portion of said first side portion by said adjustment apparatus to thereby cause said first side portion, including said rim portion, to move in a direction toward said second side portion, and wherein when said screw member is rotated in a second direction that is different from said first direction, pressure is applied to a portion of said first side portion by said adjustment apparatus to thereby cause said first side portion, including said rim portion, to move in a direction away from said second side portion.

19. The toy of claim 18 wherein said nut member has first and second internally threaded thru-bores located in a side-by-side relation, wherein said screw member is threadedly engaged to said first thru-bore, and wherein said axle structure includes an axle member that has exterior threads engaged to said second thru-bore.

20. The toy of claim 19 wherein said axle member has a longitudinal axis and wherein said first thru-bore is located to one side of said axis.

* * * * *